US008753112B2

(12) United States Patent
Armanni et al.

(10) Patent No.: US 8,753,112 B2
(45) Date of Patent: Jun. 17, 2014

(54) GAS BURNER

(75) Inventors: Piero Armanni, Forli (IT); Marco Starnini, Forli (IT); Nico Biagioli, Sansepolcro (IT); Nicola Guardigli, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 237 days.

(21) Appl. No.: 13/148,790

(22) PCT Filed: Mar. 8, 2010

(86) PCT No.: PCT/EP2010/001425

§ 371 (c)(1),
(2), (4) Date: Nov. 23, 2011

(87) PCT Pub. No.: WO2010/105748

PCT Pub. Date: Sep. 23, 2010

(65) Prior Publication Data

US 2012/0070791 A1 Mar. 22, 2012

(30) Foreign Application Priority Data

Mar. 18, 2009 (EP) ..... 09003861

(51) Int. Cl.
*F23D 14/62* (2006.01)

(52) U.S. Cl.
USPC ..... 431/354; 431/284; 126/39 R; 126/39 E; 126/39 K

(58) Field of Classification Search
USPC ..... 431/284, 354; 126/39 R, 39 E, 39 K
See application file for complete search history.

(56) References Cited

U.S. PATENT DOCUMENTS

| | | | | |
|---|---|---|---|---|
| 3,606,612 | A * | 9/1971 | Reid, Jr. | 431/281 |
| 4,083,355 | A * | 4/1978 | Schwank | 126/39 J |
| 4,938,687 | A * | 7/1990 | Monteil | 431/264 |
| 5,385,467 | A * | 1/1995 | Sebastiani et al. | 431/326 |
| 5,704,778 | A | 1/1998 | Hsieh | |
| 5,842,849 | A * | 12/1998 | Huang | 431/284 |
| 6,889,685 | B2 * | 5/2005 | Dane | 126/39 B |

(Continued)

FOREIGN PATENT DOCUMENTS

| | | | |
|---|---|---|---|
| DE | 8513182 | | 8/1985 |
| WO | WO 2006114063 | A1 * | 11/2006 |
| WO | 2008116773 | | 10/2008 |

OTHER PUBLICATIONS

International Search Report for PCT/EP2010/001425, dated Apr. 4, 2011, 2 pages.

*Primary Examiner* — Jorge Pereiro
(74) *Attorney, Agent, or Firm* — Pearne & Gordon LLP

(57) ABSTRACT

A gas burner with a plurality of concentric flame crowns including a burner body, a first central burner, and a second outer annular burner surrounding the first central burner, where the first central burner includes a first diffusion chamber and a first gas injector configured to inject a gas flow into a first Venturi pipe which is configured to convey the gas flow to the first diffusion chamber, and where the second outer annular burner includes two separate outer diffusion chambers and two distinct outer injectors each of which is configured to inject a gas flow into one of two outer Venturi pipes which are configured to convey the gas flows to the two separate outer diffusion chambers, and where the first gas injector, the first Venturi pipe, and the two outer Venturi pipes are substantially horizontally oriented.

15 Claims, 12 Drawing Sheets

(56) References Cited

U.S. PATENT DOCUMENTS

| | | | | |
|---|---|---|---|---|
| 7,594,812 | B2 * | 9/2009 | Armanni | 431/283 |
| 8,206,148 | B2 * | 6/2012 | Paesani | 431/284 |
| 8,221,116 | B2 * | 7/2012 | Biagioli et al. | 431/284 |
| 2001/0010897 | A1 * | 8/2001 | Dane | 431/266 |
| 2003/0075164 | A1 * | 4/2003 | Dane | 126/39 R |
| 2007/0141521 | A1 * | 6/2007 | Armanni | 431/354 |
| 2007/0218414 | A1 * | 9/2007 | Harneit | 431/354 |
| 2008/0202494 | A1 * | 8/2008 | Paesani | 126/39 E |
| 2008/0241777 | A1 * | 10/2008 | Rossi et al. | 431/354 |
| 2009/0047611 | A1 * | 2/2009 | Armanni | 431/284 |
| 2010/0092902 | A1 * | 4/2010 | Paesani et al. | 431/354 |
| 2010/0163013 | A1 * | 7/2010 | Serenellini et al. | 126/39 E |
| 2010/0206293 | A1 * | 8/2010 | Padgett et al. | 126/39 E |
| 2010/0233643 | A1 * | 9/2010 | Biagioli et al. | 431/284 |
| 2010/0279238 | A1 * | 11/2010 | Harneit | 431/144 |

* cited by examiner

GAS BURNER

The invention here described relates to an improved, preferably household gas burner, generally used in the cooking gas appliances.

In the following of this description it will be referred to a gas burner provided with both a central body with a peripheral flame crown, and a peripheral body provided with two or more flame crowns, oriented inwards and outwards, but it will be intended that what explained may be identically applied and therefore valid also for gas burners provided with a peripheral body on which only one flame crown is arranged, which can be oriented either inwards, or outwards.

The most relevant prior art regarding the instant invention is undoubtedly the EP Pat. Application No. 07119078.9; and the documents/patents therein cited; therefore, for the sake of brevity, what therein discussed regarding the prior art is here only recalled but not repeated.

Said European patent application proposes a gas burner which is surely improved with respect to the prior art as it solves some important functional and assembly problems.

Figure 3:
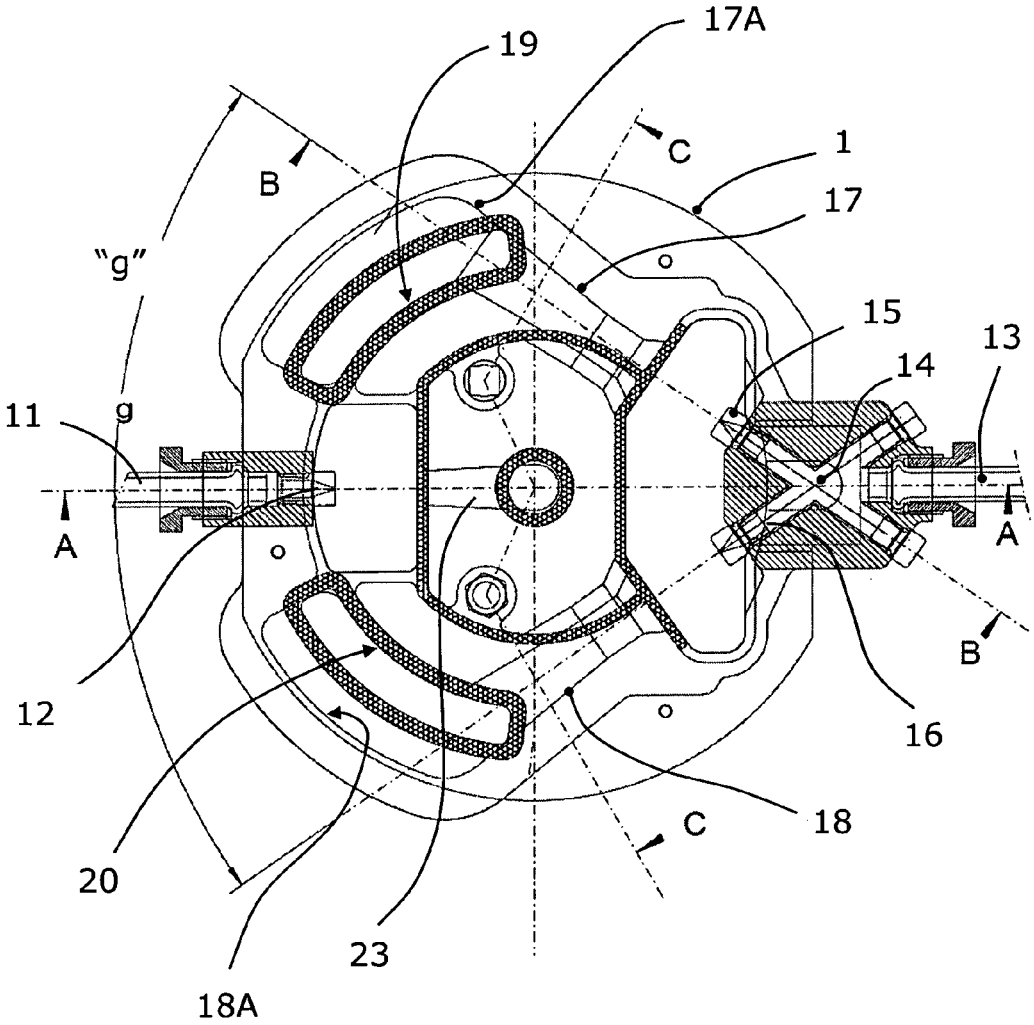

However, after an exhaustive experience of the functional and mounting features of said gas burner in the actual use, it was observed that the kind of gas burner as therein described still shows the following problems:

first of all the vertical arrangement of the central Venturi pipe, which supplies the gas to the central burner, certainly causes an obstacle to the height reduction of the whole cooking plate; said height reduction is instead a permanent goal by all the producers of that kind of gas burners, as it is more and more appreciated by the final users;

moreover the primary air for the central burner, as well as for the outer annular burner, is sucked from a peripheral zone which is just around the outer flame crown, as shown by the arrows indicating the primary air flow in FIG. 3 of the cited prior European patent application, which is improved by the instant invention.

Such a situation gives rise to an unavoidable over-heating of said primary air flow which is sucked, so causing an apparent worsening of the combustion quality, especially for the central burner whose primary air flow is reduced due to the fact that most of the primary air flows, which is sucked into the common sucking path between the central and the annular burners, is taken by the two angled Venturi pipes of the outer annular burner, or consumed as secondary air by the flames of the two inner crowns; furthermore the air temperature increase reduces the oxygen mass fraction of the air flow.

Furthermore the smallness of the reciprocal angle between the two angled Venturi pipes, identified as 17 and 18 in the cited EP patent application, may cause some turbulence inside the relevant diffusion chambers 21, 22, as the walls of said diffusion chambers, against which the relevant primary gas flows hit, are almost orthogonal to the directions of the respective gas flows.

From WO 2008/116773 A2 (DEFENDI) it is divulged a kind of gas burner for household appliances provided with a pair of first injectors of substantially horizontal axis, and symmetrically disposed, said first injectors being associated with respective adjacent Venturi conduits with parallel axis, and spaced to each other to define a space within which a second injector of vertical axis is disposed facing a Venturi conduit of vertical axis feeding the inner portion of the gas appliance.

However said gas appliance proves to be a little critical to be used, as the two horizontal injectors feed only one outer chamber (47), and this circumstance may create some safety problems in the gas circulation inside said chamber when one of said injectors is accidentally closed.

Moreover the circumstance that the central Venturi is vertically oriented may decrease the possibility of using said gas burner in appliances wherein a very reduced height is mandatory.

It would therefore be desirable, and is actually a main purpose of the present invention, to provide a type of gas burner provided with a central body and with a peripheral annular body separate to each other, which are all provided with respective injectors and Venturi pipes horizontally oriented, and are able of exploiting basically the whole burner cross size (width) in order to allow the lodging of said plurality of separate Venturi pipes, and in the same time to reduce the overall height of the cooking plate without generating turbulence in the primary air flow.

Figure 1:
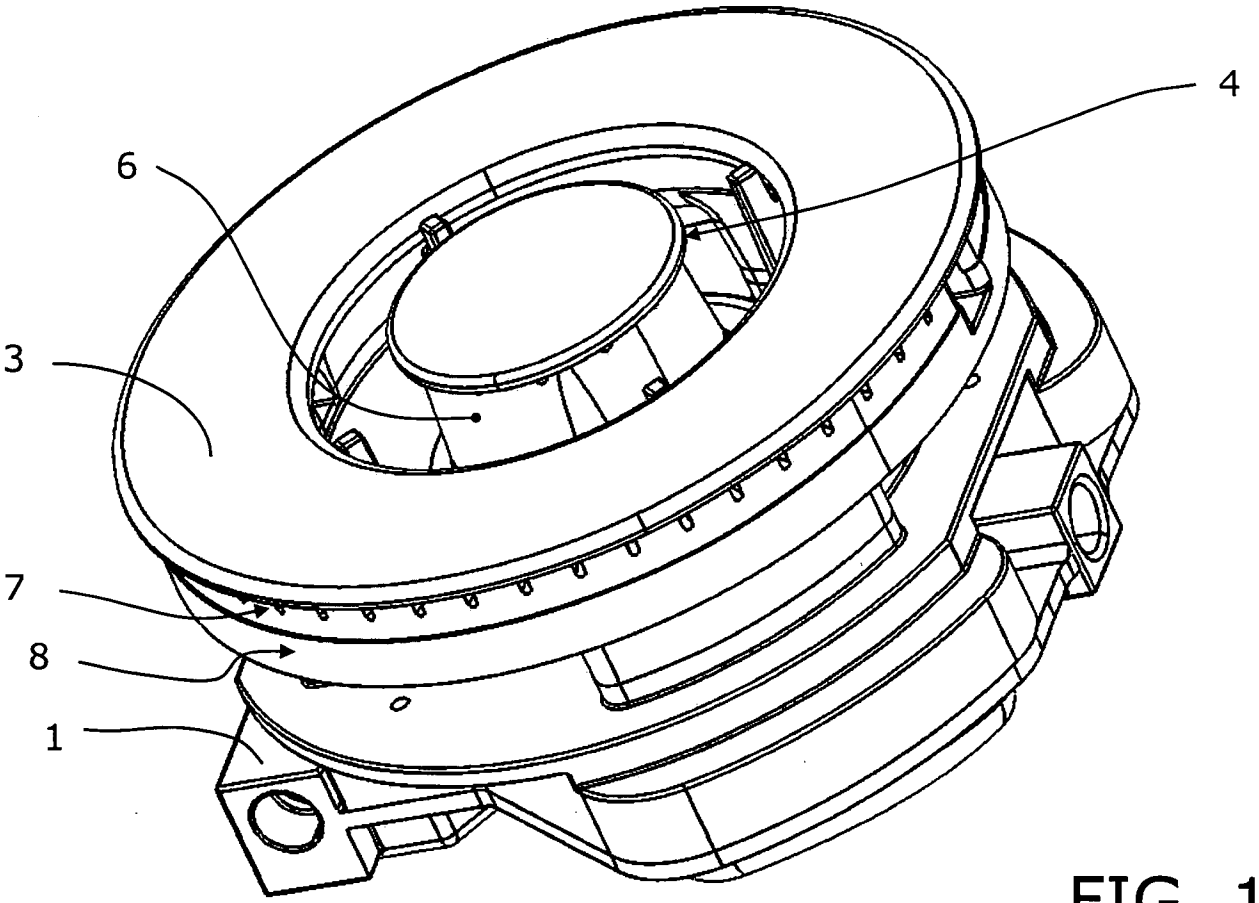
Figure 2:
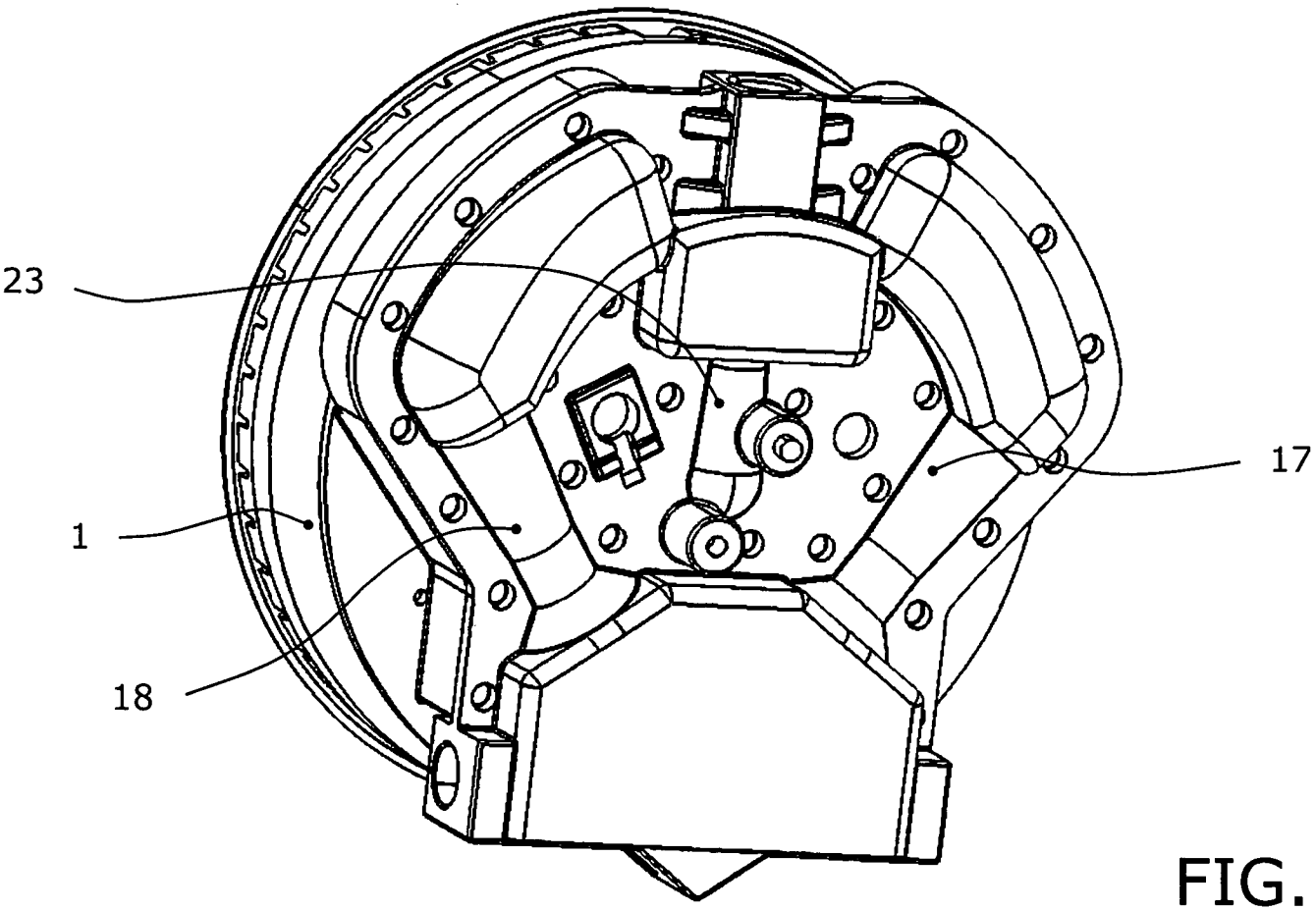
Figure 4:
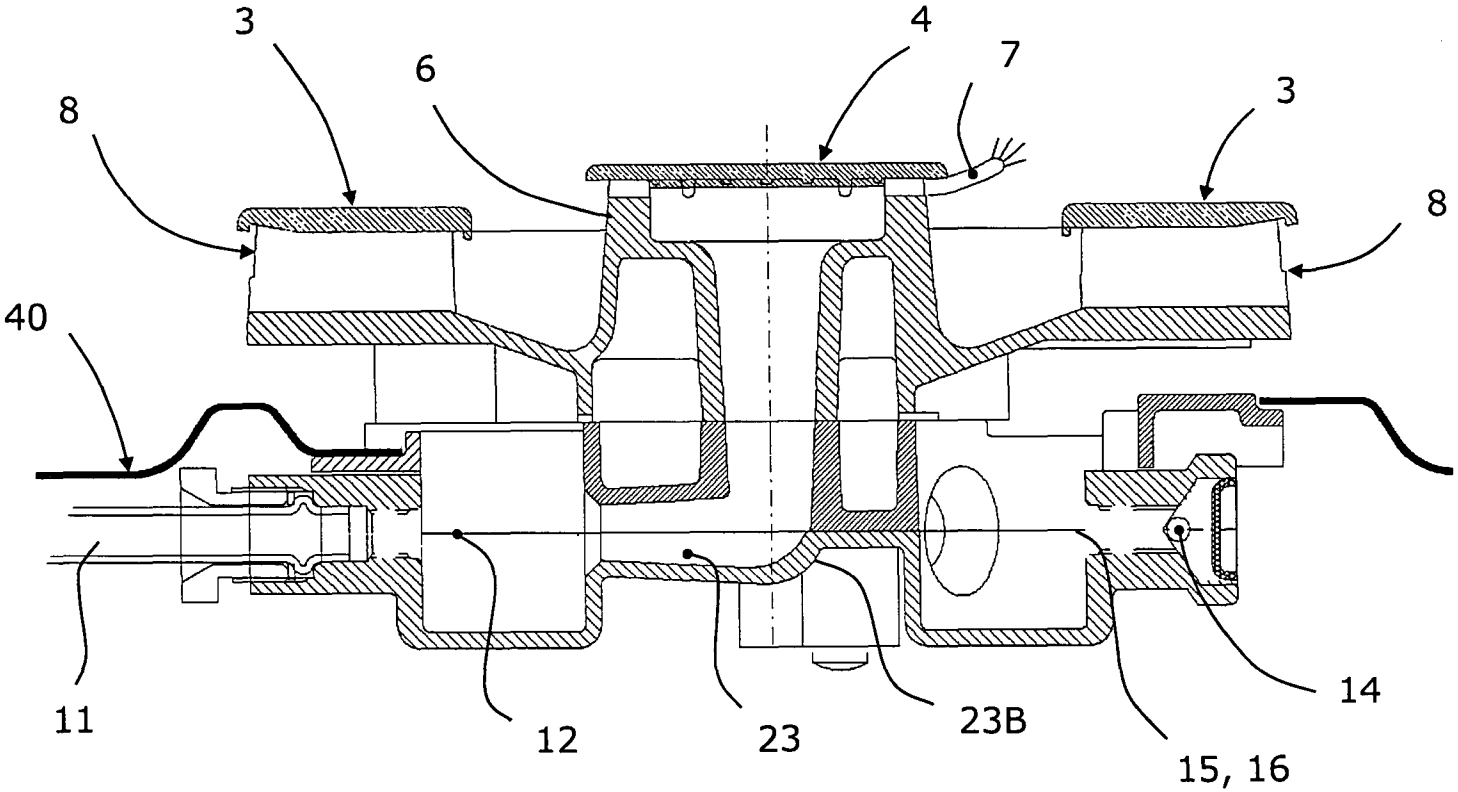
Figure 5:
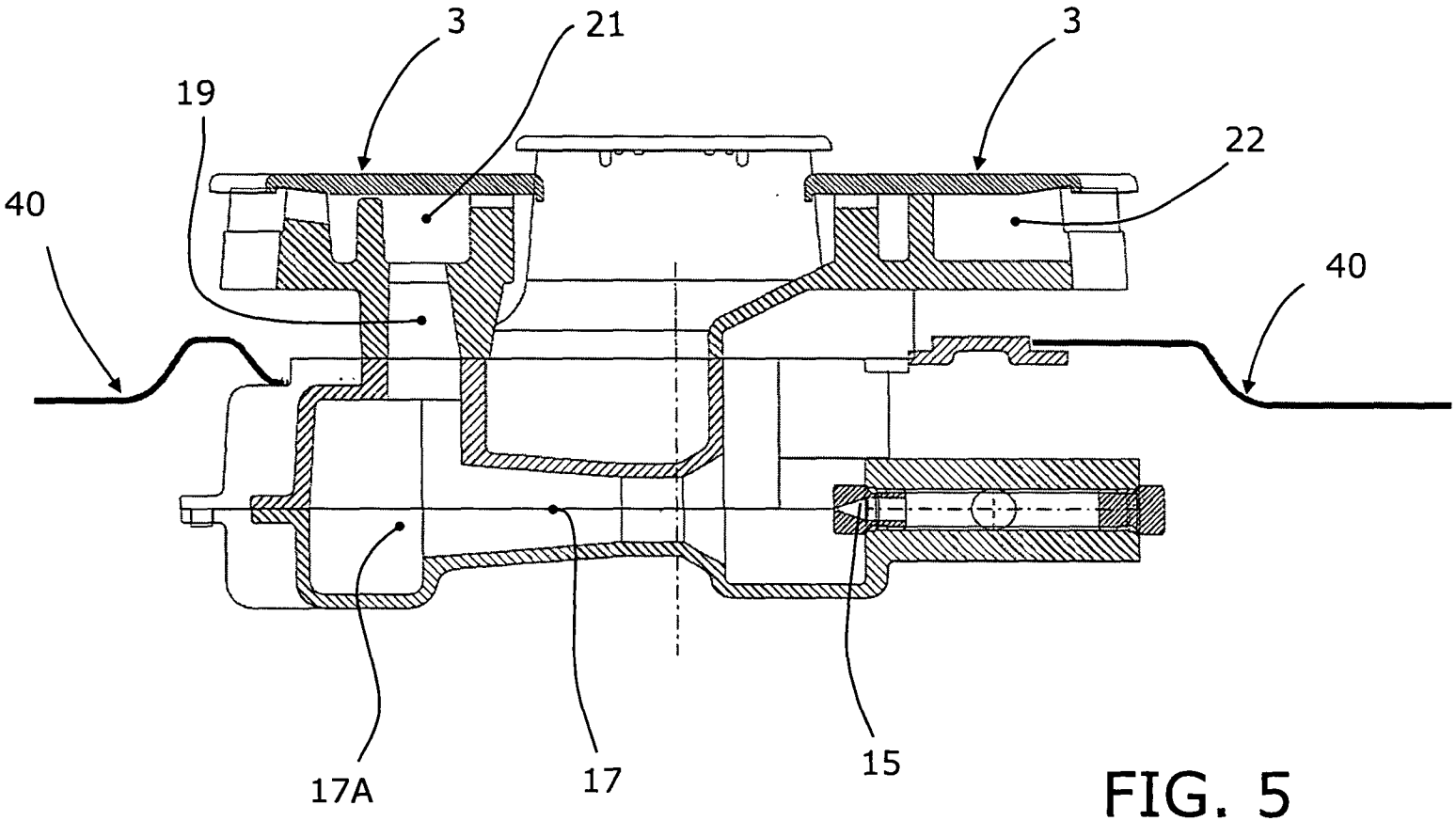
Figure 6:
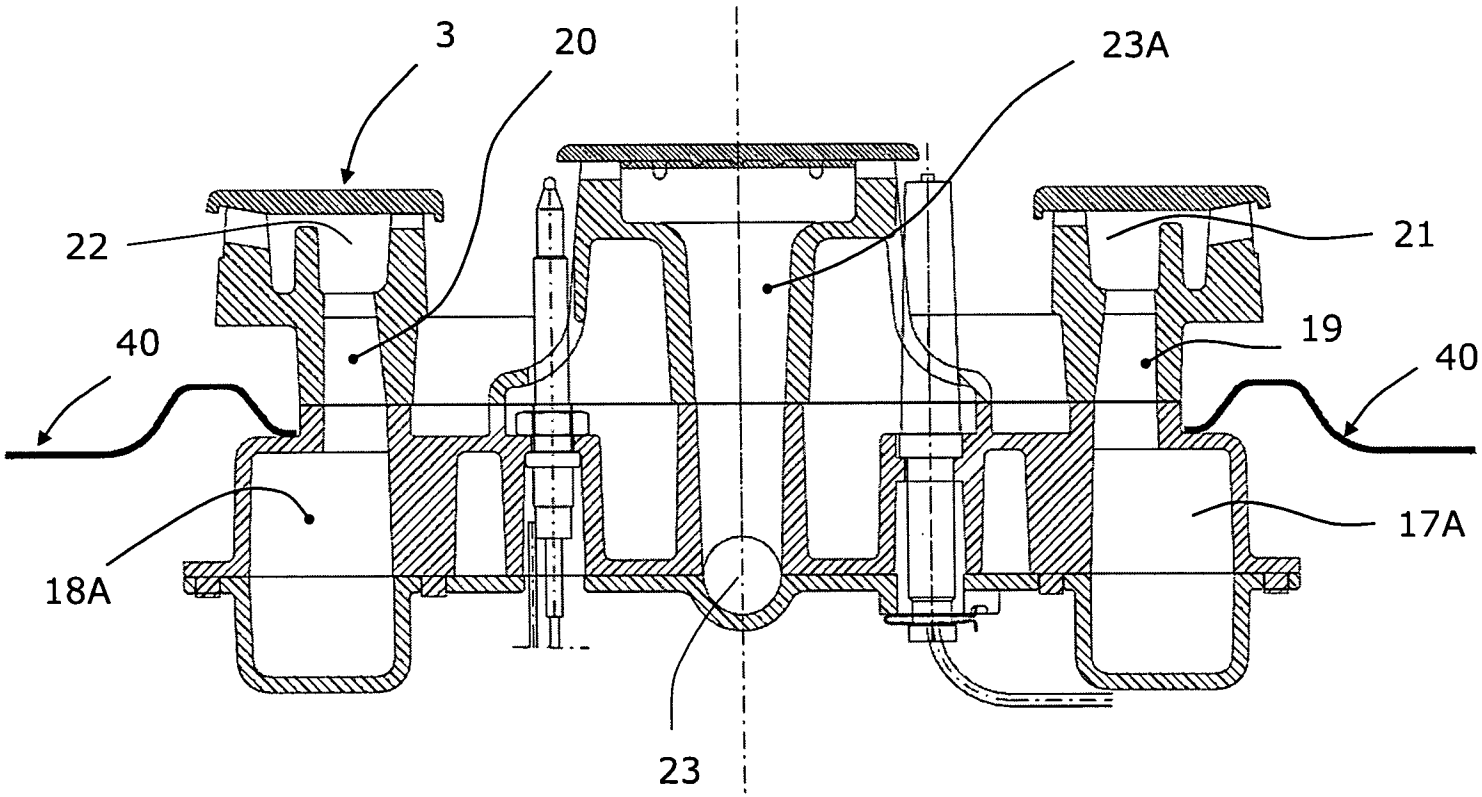
Figure 7:
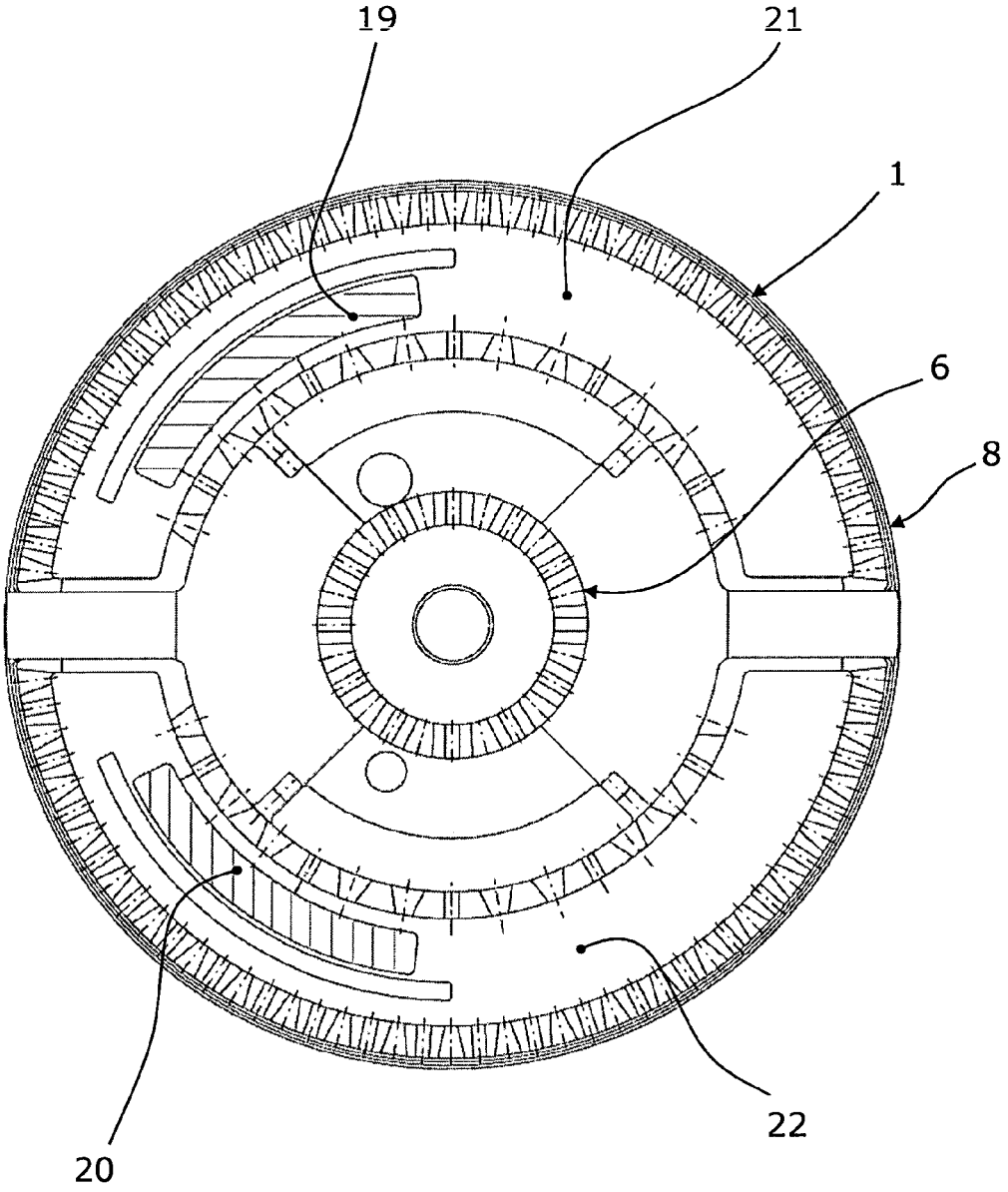
Figure 8:
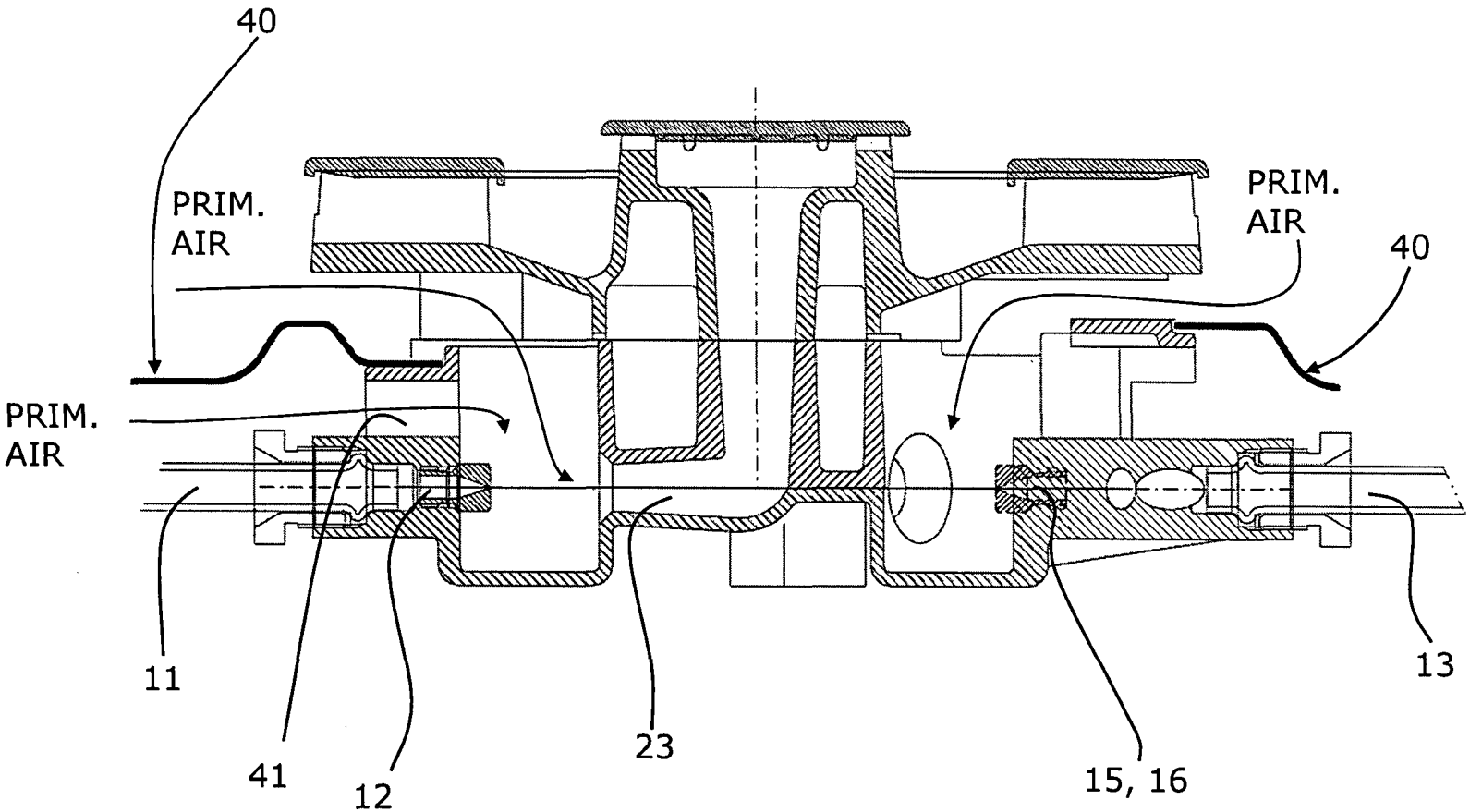
Figure 9:
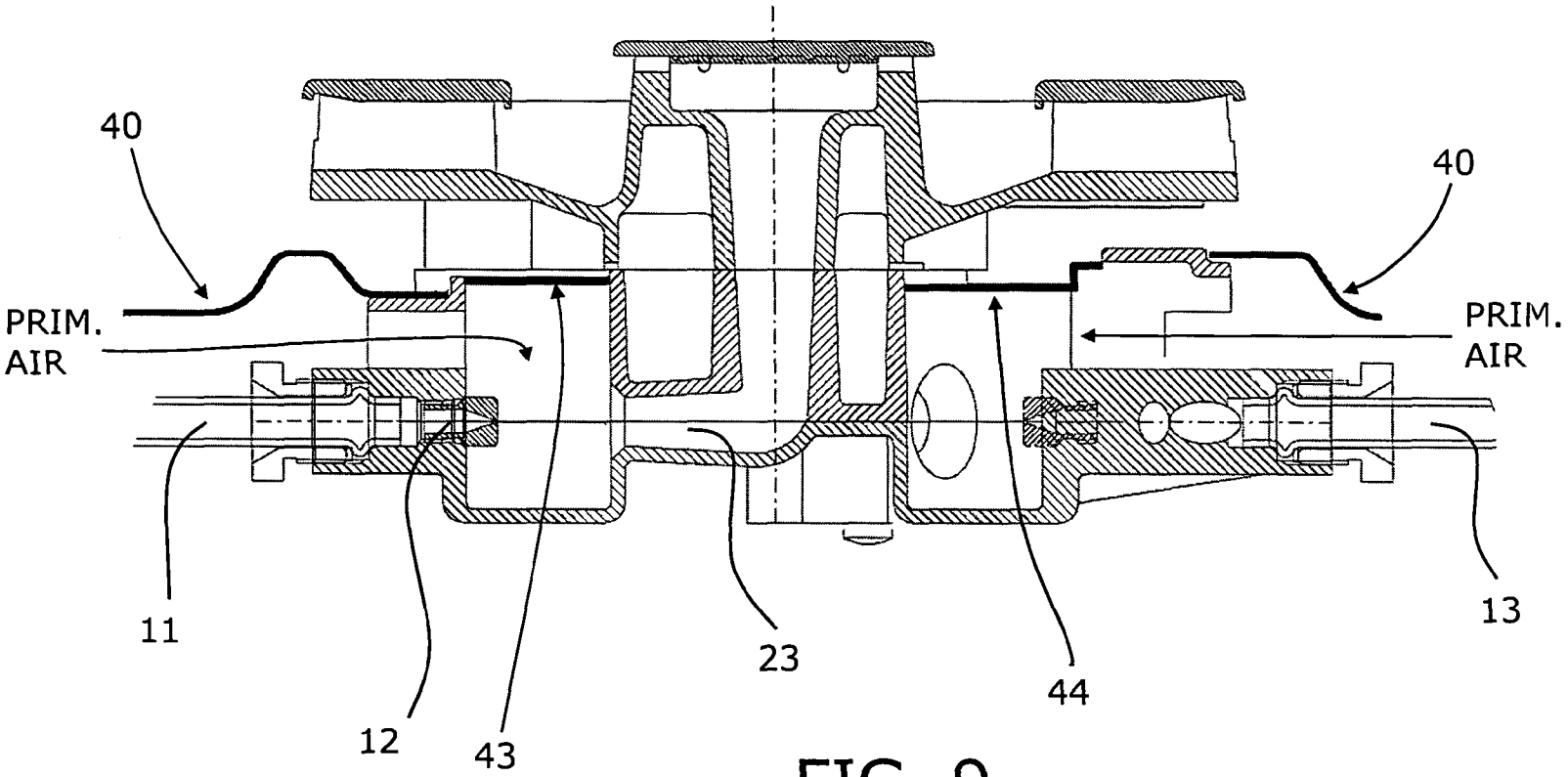

According to the present invention, this and further aims are reached in a kind of burner incorporating the characteristics as recited in the appended claims and including such operating means as described below by mere way of non-limiting example with reference to the accompanying drawings, in which:

FIG. 1 and FIG. 2 show perspective and exploded views of a burner according to the invention, respectively represented from above and from below, FIG. 3 shows a plan transparent and top view of a burner according to the invention, FIG. 4 shows a vertical plane section of a first embodiment of the invention, according to the section A-A of FIG. 3, FIG. 5 shows a vertical plane section of the burner of FIG. 3, according to its section B-B of FIG. 3, FIG. 6 shows a vertical section of the burner of FIG. 3, according to the section C-C of the same figure, FIG. 7 shows a top plan view of the portion of the burner of FIG. 3, deprived of the covers of the chambers diffusing the gas, FIG. 8 shows a vertical plane, similar to FIG. 4, of a second embodiment of the burner of the invention, FIG. 9 shows a vertical plane, similar to FIG. 4, of a third embodiment of the burner of the invention.

Figure 10:
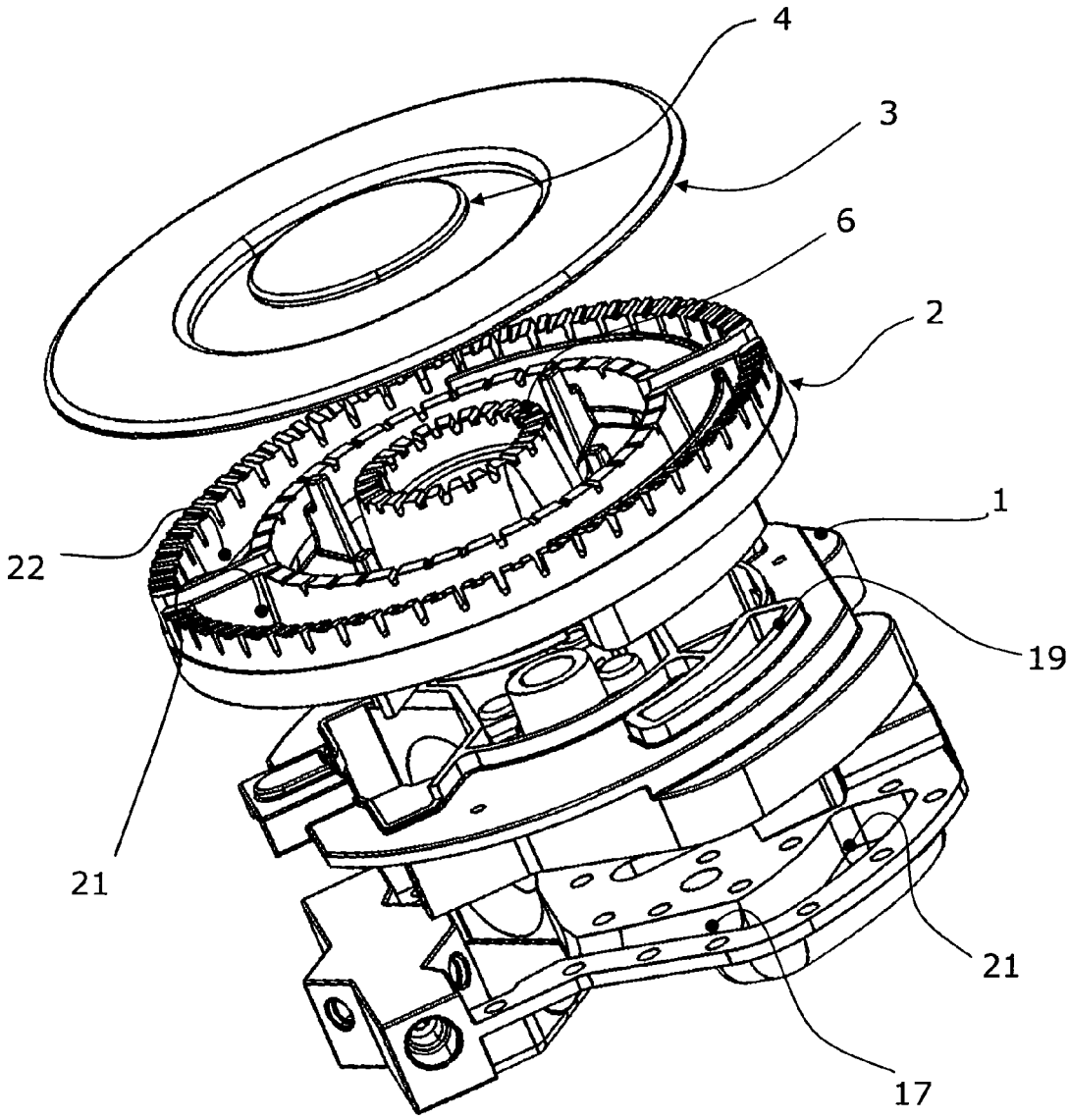
Figure 10A:
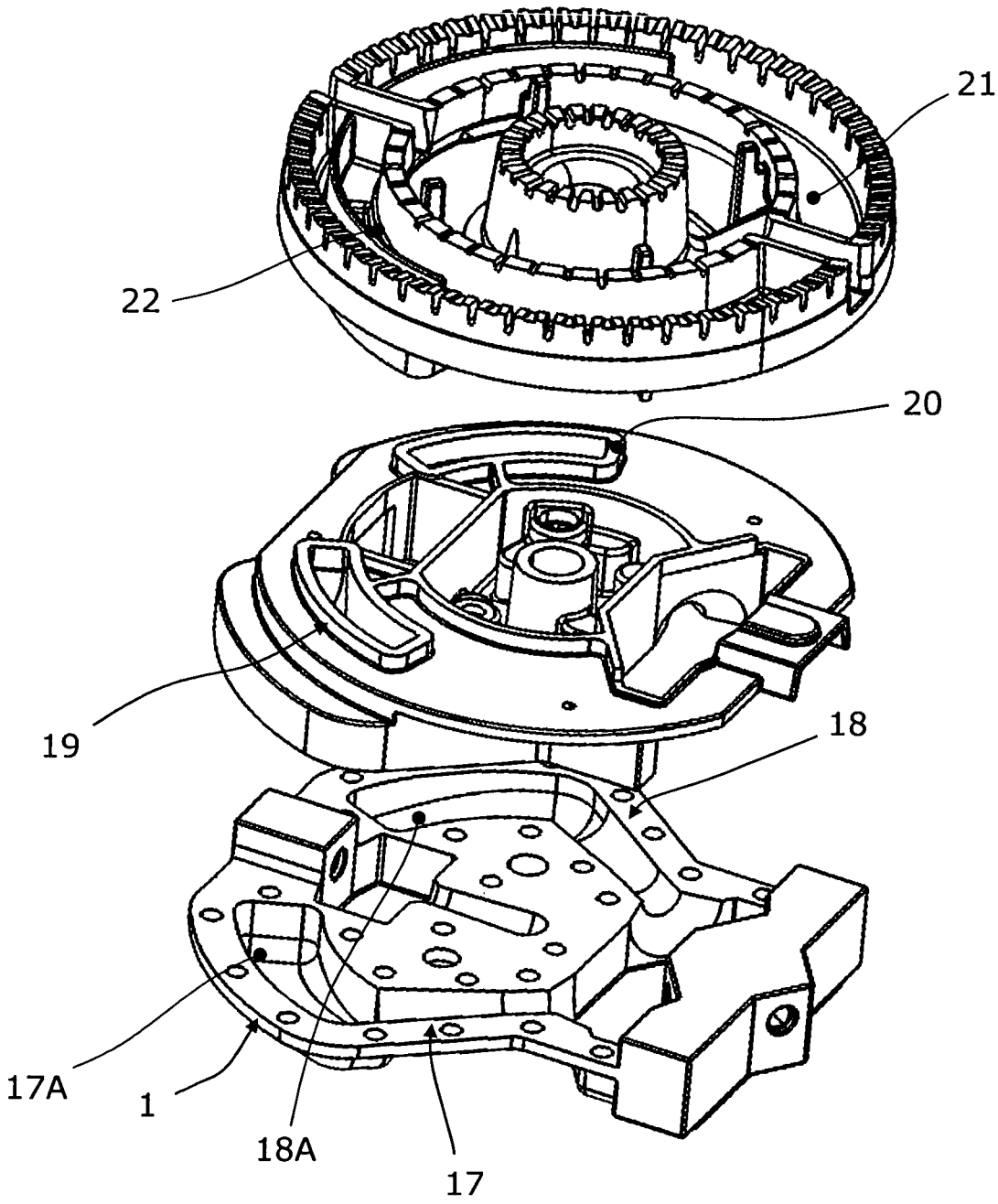
Figure 11:
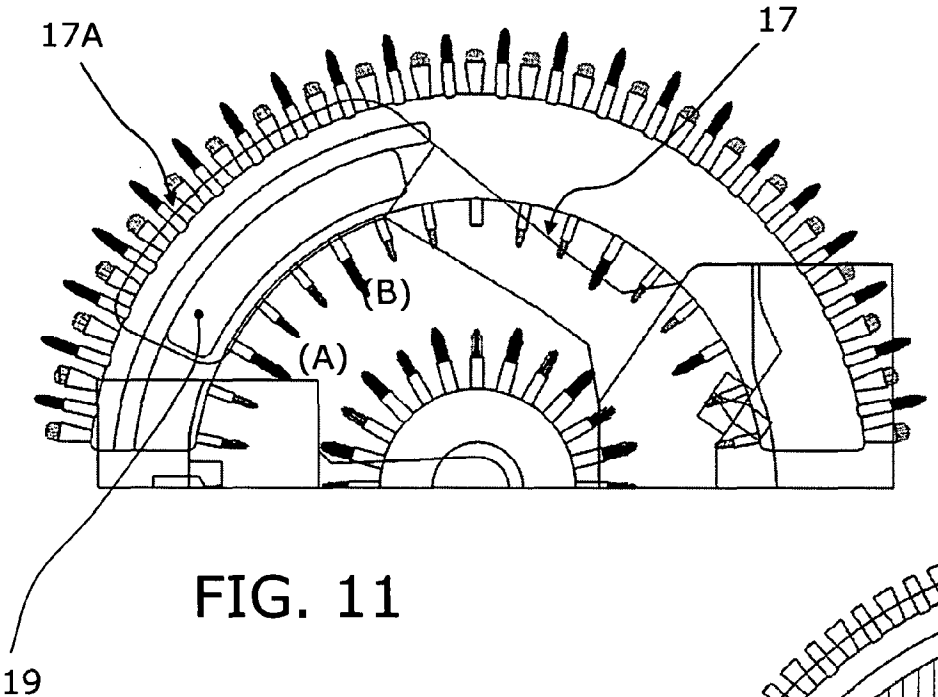
Figure 11A:
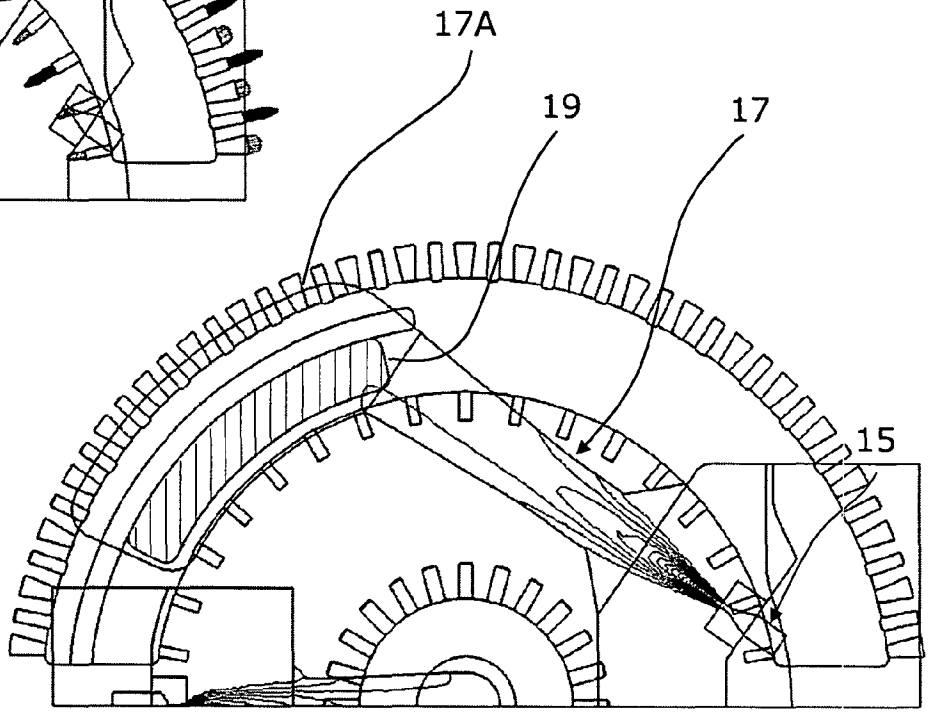

FIG. 10 shows an exploded perspective view of the burner of FIGS. 1 and 2, FIG. 10A shows in a better detail the exploded perspective view of FIG. 10, FIGS. 11 and 11A show respective and pictorial transparent views of a burner portion according to the invention, observed from top.

With reference to figures, a gas burner according to the cited prior art, and typically devoted to fit out a cooking appliance, not shown, comprises:

a burner body 1 and an upper crown 2, a first central and circular burner 6, per se known, able of feeding a peripheral flame crown 7, and a related cover 4, and a second annular peripheral burner 8 which surrounds said first central burner 6 at a definite distance thereof, and a related cover 3; said second annular burner having one or more flame crowns which are either inwards, i.e. oriented towards the first burner, or outwards, or both said arrangements.

According to the invention, said burner body includes a conduit which acts as a first gas inlet 11, which ends into a respective injector 12 which is horizontally oriented and a related Venturi pipe 23 which is:

horizontally oriented, and which continues as a conduit 23A which is vertically oriented, until it reaches the relevant diffusion chamber placed under the corresponding central cover 4.

It is to be noted that said vertical conduit 23A is not a part of the Venturi pipe 23 and separated by said horizontal Venturi 23 by a right-angled bend 23B.

It is now clear that said orientation of the first Venturi pipe 23 allows a lower height of the whole gas burner, so achieving one of the main goals of the instant invention.

Moreover a more extended length of said same first Venturi pipe can so been gained, thanks to the fact that it may exploit at least half of the burner width, from its perimetral edge to its center.

The means to lead the gas into said second annular burner 8 comprise a second gas burner inlet 13 which enters said burner body and which reaches an end position 14, wherefrom two distinct gas paths are being originated, wherein each path comprises a respective injector 15, 16 and a respective Venturi pipe 17, 18.

Said end position 14 is practically arranged on the outer lower side of said burner body, i.e.: where said second gas inlet 13 enters the volume of said burner body, there it terminates to said end position 14.

Both said two injectors 15, 16 and the relevant Venturi pipes are horizontally oriented and basically they lie on the same plane of said second inlet 13.

As shown in FIG. 3, said first horizontal Venturi pipe 23, and the relevant vertical conduit 23A, are lodge between the two Venturi pipes 17, 18; and preferably said first injector 12 is placed in the opposite side with respect to said end position 14, and the relevant horizontal Venturi pipe 23 is centrally placed inside said angle "g", in order to achieve a perfect symmetry of the whole burner body.

The just described solution allows some profitable improvements which further make easier the burner functional flexibility.

It is assumed that the implementation of the second annular burner 8 and of the conduits which supply it with gas are substantially similar to the embodiment described in the cited prior art European patent application, which here is briefly reminded (the following figures refer to the instant pat. application):

Said injectors 15, 16, branching out from said same end position 14, have to be properly angled to each other by the angle "g" shown in FIG. 3, and obviously even the two Venturi pipes 17, 18 are oriented in a way aligned with the respective injectors 15, 16, i.e. they are angled between them, and this permits that in the axial, that is in central zone of the burner body, said two Venturi pipes be diverted at a certain distance, in order to allow between them a proper room to lodge said horizontal Venturi pipe 23, together with said vertical conduit 23A and the related right-angled bend 23B relevant to said central burner 6, as particularly shown in the FIGS. 1 to 4.

In order to optimize the functional and productive features, the two injectors 15 and 16 and related Venturi pipes 17, 18 are symmetrically positioned with respect to a vertical symmetry plane, logically passing through the central section "A-A" (see FIG. 3) of the burner body.

It is here reminded that, according to the cited prior art, said two Venturi pipes 17, 18 admit into respective gas diffusion chambers 21, 22 which are separate, and not intercommunicating to each other, and arranged below said annular cover 3 and which are respectively connected to the end portions of respective said angled Venturi pipes 17, 18 through respective vertical conduits, identified as 19 and 20 in the cited prior art; said diffusion chambers 21, 22 are provided with suitable ports leaving the air-gas mixture to flow out to be burned, as usual.

However, according to this invention, the angle between said Venturi pipes 17, 18 must be not too little, but on the contrary it must be quite close to a right angle for the following and concordant reasons:

1) if the angle between said Venturi pipes 17, 18 is too small, then the drawback is experienced that the two gas flows of said two Venturi pipes go and almost orthogonally hit the respective front walls.

This creates an undesired turbulence inside the diffusion chambers 21, 22 which are arranged near and above the end zone of said Venturi pipes, and which provide the gas to the relevant ports, and an increase of static pressure in the gas ports facing the vertical conduits 23A and 23B.

As a matter of facts, it is just to avoid said turbulence that in the cited prior patent the deflections means (31) have been proposed; the solution here described is an improvement of that one previously described in the cited EP No. 07119078.9.

Differently from that, according to this improvement, in order to implement a gas path which be as regular as possible, advantageously at the end of each of said Venturi pipes 17, 18 a respective curved chamber 17A, 18A is arranged, which is basically horizontal and arc-shaped, i.e. showing a form which is similar to a peanut, and extended below a respective said diffusion chambers 21, 22 (see FIG. 6).

Said curved chambers 17A, 18A are connected to the above arranged diffusion chambers 21, 22 through respective wide passages 19, 20, which here take an enlarged shape, and generally similar to the shape of the respective diffusion chambers 21, 22 in order to directly connect the most part of said curved chambers 17A, 18A, to the largest extension of said respective diffusion chambers 21, 22.

Moreover, as a further requirement, in order to prevent the gas flow from said Venturi pipes from orthogonally hit a vertical wall of a respective said curved chambers 18A, 19A, it needs that said gas flows show a direction as aligned as possible to said curved chambers.

2) According to the following improvement, this is possible if a Venturi pipe 17, 18 is tangentially oriented to a respective said curved chamber, and said characteristic is as much implemented as much:

the relevant Venturi pipe is angled, hawing regard to the other requirements, the end section of the Venturi pipe admits into respective said curved chamber in its portion which is the farthest from the symmetry plane (see section A-A) of said gas burner, and therefore in its portion which is closer to respective said injectors 15, 16.

It was observed and experienced that this condition is better met, in a burner having usual sizes for a household use, when the angle "g" between said Venturi pipes 17, 18 is larger than 45°.

The FIG. 4 shows the vertical section of a burner in the most accepted and usual embodiment, wherein the primary air is exclusively taken from above the working plate.

However different and advantageous embodiments may be proposed, which are more tailored to specific constructional and functional purposes.

3) The third improvement consists in that the primary air, both for the central and for the outer annular burners, is taken both from above and from below the working plate, as shown in FIG. 8, wherein the same working plate 40 acts as the separation means of said two primary air flows.

This causes an improvement of the burner performances and of the flexibility in the relevant applications in many existing appliances, as the air inlet mouths are actually split into two distinct and separated mouths.

Specifically, as shown in the same FIG. 8, it is quite useful that the primary air flow supplying said injector 12 (relevant to the central burner) from below, be conveyed by an air channel 41 which is substantially parallel to said injector 12 and therefore horizontal, and next to it.

This circumstance allows of remarkably reducing the turbulence which, otherwise, would be created in the respective Venturi pipe, with negative effects on the air-gas mixing and on the related flame.

4) A fourth profitable embodiment is shown in FIG. 9; in it the whole primary air flow, for both burners, is taken only from below the working plate 40.

Such a solution appears to be particularly interesting if it is absolutely wanted of avoiding that said primary air flow may be in some amount over-heated by the above burning flames what, as before explained, would cause serious drawbacks in the air-gas mixing.

Such a solution is easily implemented by arranging one or more proper separating septa 43, 44 in the air primary air paths coming from above the working plate 40, if it is realized according to the previously described embodiment.

Such a solution apparently allows the advantage that the same burner type may be mounted on demand on the same cooking plate, and yet it may work according to the two different working modes, provided very cheap and simple devices, i.e. the septa 43, 44, are properly mounted/dismounted.

Obviously in this case too an improved embodiment consist in that the primary air coming from below the working plate, and which supplies the injector 12 (for the central burner), be conveyed through a channel 41 substantially parallel to said injector, and therefore horizontal, and next to it.

5) A fifth improvement consists in that the first gas inlet 11 and the second gas inlet 13 are arranged on the same diameter of the burner body, and on opposite sides with respect to the burner centre; apparently said symmetrical embodiment helps rationalizing the general design, making uniform the burner performances and remarkably reducing the burner production costs.

The above solutions appear to be particularly interesting in those markets were national standards and legislations do not allow the possible spillage to enter the burner.

As a matter of facts, it is remarkable to point out that a worldwide safety standards devoted to household gas appliances/burners does not exist.

Moreover, the circumstance that the two injectors 15 and 16 and their related Venturi pipes are widely spaced to each other greatly reduces the risk of possible disturbance and turbulences between the two flows.

The invention claimed is:

1. Gas burner provided with a plurality of concentric and substantially circular flame crowns comprising:

a burner body (1) adapted to be mounted on a surface of a cooking plate (40);

a first central burner (6) adapted to supply a first peripheral flame ring;

a second outer annular burner (8) surrounding said first central burner at a defined distance and adapted to supply at least a respective second peripheral flame ring;

a first gas inlet (11) in communication with said burner body;

a first gas injector (12), adapted to inject a gas flow into a respective first Venturi pipe (23) which conveys an air-gas mixture to said first central burner (6);

said first central burner comprising a first diffusion chamber for the diffusion of the air/gas mixture, a plurality of ports to let said mixture out, and wherein a top of said first central burner is closed by a first cover (4);

a second gas inlet (13) in communication with said burner body; wherein said second outer annular burner (8) comprises two separate outer diffusion chambers (21, 22) for the diffusion of said mixture, wherein a top of said second outer annular burner is closed by a second cover (3), and wherein said second gas inlet (13) is in communication with said two separate outer diffusion chambers (21, 22), which are not in communication to each other, through injection and conveying means comprising:

two distinct outer injectors (15, 16) in communication with said second gas inlet (13), and placed on a same end position (14) of said second gas inlet (13) and reciprocally separated from each other, and also in a lower portion and substantially in a side portion of said burner body (1);

two respective outer Venturi pipes which are substantially horizontally oriented (17, 18), each adapted to supply said air/gas mixture to a respective one of said two outer diffusion chambers (21, 22), wherein said first gas injector (12) and said respective first Venturi pipe (23) for the central burner (6) are substantially horizontally oriented (23), wherein said two outer Venturi pipes (17, 18) connect into two respective outer curved chambers (17A, 18A) comprising two respective outer vertical gas passages (19, 20) connecting said outer curved chambers to said respective outer diffusion chambers (21, 22), wherein said outer Venturi pipes (17, 18) connect into said respective outer curved chambers (17A, 18A) on respective portions which are closer to said respective outer injectors (15, 16).

2. Gas burner according to claim 1, wherein said first Venturi pipe (23) for the central burner connects into a vertically oriented conduit (23A) by a right-angled bend (23B).

3. Gas burner according to claim 2, wherein said first Venturi pipe (23) for said central burner is positioned between the two outer Venturi pipes (17, 18) dedicated to said two outer diffusion chambers (21, 22).

4. Gas burner according to claim 3, wherein the first gas injector (12) for said central burner is arranged in an opposite position to said end position (14) of said second gas inlet (13).

5. Gas burner according to claim 3, wherein said two outer Venturi pipes (17, 18) are symmetrically placed with respect to a vertical section (A-A) of said burner body.

6. Gas burner according to claim 1, wherein said two horizontal and separate outer injectors (15, 16) are placed on the same end position (14) of said second gas inlet (13).

7. Gas burner according to claim 1, wherein said two separate outer injectors (15, 16) are reciprocally angled from each other by an acute angle ("g"), larger than 45°.

8. Gas burner according to claim 1, wherein said outer vertical gas passages (19, 20) extend substantially the whole length of said outer curved chambers (17A, 18A).

9. Gas burner according to claim 1, wherein said first gas inlet (11) and said second gas inlet (13) are arranged on a same diameter of the burner body, and on opposite sides thereof.

10. Gas burner provided with a plurality of concentric and substantially circular flame crowns comprising:

a burner body (1) adapted to be mounted on a surface of a cooking plate (40);

a first central burner (6) adapted to supply a first peripheral flame ring;

a second outer annular burner (8) surrounding said first central burner at a defined distance and adapted to supply at least a respective second peripheral flame ring;

a first gas inlet (11) in communication with said burner body;

a first gas injector (12), adapted to inject a gas flow into a respective first Venturi pipe (23) which conveys an air-gas mixture to said first central burner (6);

said first central burner comprising a first diffusion chamber for the diffusion of the air/gas mixture, a plurality of ports to let said mixture out, and wherein a top of said first central burner is closed by a first cover (4);

a second gas inlet (13) in communication with said burner body; wherein said second outer annular burner (8) comprises two separate outer diffusion chambers (21, 22) for the diffusion of said mixture, wherein a top of said second outer annular burner is closed by a second cover (3), and wherein said second gas inlet (13) is in communication with said two separate outer diffusion chambers (21, 22), which are not in communication to each other, through injection and conveying means comprising:

two distinct outer injectors (15, 16) in communication with said second gas inlet (13), and placed on a same end position (14) of said second gas inlet (13) and reciprocally separated from each other, and also in a lower portion and substantially in a side portion of said burner body (1);

two respective outer Venturi pipes which are substantially horizontally oriented (17, 18), each adapted to supply said air/gas mixture to a respective one of said two outer diffusion chambers (21, 22), wherein said first gas injector (12) and said respective first Venturi pipe (23) for the central burner (6) are substantially horizontally oriented (23) wherein, when said gas burner is mounted on the surface of the cooking plate (40), primary air both for the first central burner (6) and for the second outer annular burner (8) is taken both from above and from below said cooking plate (40).

11. Gas burner according to claim 10, wherein said two outer Venturi pipes (17, 18) connect into two respective outer curved chambers (17A, 18A) comprising two respective outer vertical gas passages (19, 20) connecting said outer curved chambers to said respective outer diffusion chambers (21, 22), and wherein said outer Venturi pipes (17, 18) connect into said respective outer curved chambers (17A, 18A) on respective portions which are closer to said respective outer injectors (15, 16).

12. Gas burner according to claim 10, wherein one or more separation septa (43, 44) are interposed into passages of the primary air leading from above the cooking plate to below the cooking plate.

13. Gas burner according to claim 10, comprising a primary air channel (41), which is parallel and close to said first gas injector (12) and which is adapted to convey an air flow sucked from below said cooking plate (40).

14. Gas burner provided with a plurality of concentric and substantially circular flame crowns comprising:

a burner body (1) adapted to be mounted on a surface of a cooking plate (40);

a first central burner (6) adapted to supply a first peripheral flame ring;

a second outer annular burner (8) surrounding said first central burner at a defined distance and adapted to supply at least a respective second peripheral flame ring;

a first gas inlet (11) in communication with said burner body;

a first gas injector (12), adapted to inject a gas flow into a respective first Venturi pipe (23) which conveys an air-gas mixture to said first central burner (6);

said first central burner comprising a first diffusion chamber for the diffusion of the air/gas mixture, a plurality of ports to let said mixture out, and wherein a top of said first central burner is closed by a first cover (4);

a second gas inlet (13) in communication with said burner body; wherein said second outer annular burner (8) comprises two separate outer diffusion chambers (21, 22) for the diffusion of said mixture, wherein a top of said second outer annular burner is closed by a second cover (3), and wherein said second gas inlet (13) is in communication with said two separate outer diffusion chambers (21, 22), which are not in communication to each other, through injection and conveying means comprising:

two distinct outer injectors (15, 16) in communication with said second gas inlet (13), and placed on a same end position (14) of said second gas inlet (13) and reciprocally separated from each other, and also in a lower portion and substantially in a side portion of said burner body (1);

two respective outer Venturi pipes which are substantially horizontally oriented (17, 18), each adapted to supply said air/gas mixture to a respective one of said two outer diffusion chambers (21, 22), wherein said first gas injector (12) and said respective first Venturi pipe (23) for the central burner (6) are substantially horizontally oriented (23) wherein, when said gas burner is mounted on the surface of the cooking plate (40), primary air both for the first central burner (6) and for the second outer annular burner (8) is taken exclusively from below said cooking plate (40).

15. Gas burner according to claim 14, wherein said two outer Venturi pipes (17, 18) connect into two respective outer curved chambers (17A, 18A) comprising two respective outer vertical gas passages (19, 20) connecting said outer curved chambers to said respective outer diffusion chambers (21, 22), and wherein said outer Venturi pipes (17, 18) connect into said respective outer curved chambers (17A, 18A) on respective portions which are closer to said respective outer injectors (15, 16).

* * * * *